United States Patent [19]

Campbell

[11] 4,135,428

[45] Jan. 23, 1979

[54] CIRCUIT FOR CONTROLLING THE EXPRESSION OF AN ELECTRONICALLY CONTROLLED KEYBOARD INSTRUMENT

[75] Inventor: Joseph M. Campbell, Lewisburg, Tenn.

[73] Assignee: Teledyne Industries, Inc., Los Angeles, Calif.

[21] Appl. No.: 792,846

[22] Filed: May 2, 1977

[51] Int. Cl.[2] ..... G10G 3/04; G10H 1/02

[52] U.S. Cl. ..... 84/1.24; 84/1.28; 84/115; 84/462; 84/DIG. 29

[58] Field of Search ..... 84/1.01–1.03, 84/1.09, 1.1, 1.22, 1.24, 1.27, 1.28, 115, 462, DIG. 29

[56] References Cited

U.S. PATENT DOCUMENTS 3,683,096 8/1972 Peterson et al. ..... 84/115

*Primary Examiner*—Stanley J. Witkowski
*Attorney, Agent, or Firm*—Jim Zegeer

[57] ABSTRACT

There is disclosed a circuit for controlling the expression of an electronically controlled keyboard instrument and is an improvement on the circuit disclosed in application Ser. No. 680,996. The circuit works on the principle that by switching a solenoid on and off at a rapid rate and then varying the time on versus the time off, the energy supplied to the solenoid varies and therefore the striking force of the piano is changed. In accordance with the present invention, precise control over the width of the pulses is achieved by first setting a set voltage level and then adding thereto increments of set voltage according to a binary weighting. These voltages are then added and compared with a triangular voltage in a comparator. Both the up ramp portion and the down ramp portion of the triangular waveform are utilized and compared against the sum voltages. The pulse width of the comparator output is thus a function of the intersection of the ramp voltage, both up and down ramps, with the sum voltage. By varying the sum voltage in digital increments the width of the pulses is varied and these pulses which are supplied to the solenoid thus have the power or energy of the solenoid varied to vary the expression effects on the playback of the piano, for example.

4 Claims, 4 Drawing Figures

BIT ASSIGNMENT

| | | | | | |
|---|---|---|---|---|---|
| 1. | $C\#_{16}$ | 44. | G# | 87. | $B_{32}$ |
| 2. | D | 45. | A | 88. | $C_{16}$ |
| 3. | D# | 46. | A# | 89. | |
| 4. | E | 47. | B | 90. | |
| 5. | F | 48. | C | 91. | |
| 6. | F# | 49. | C# | 92. | 0 |
| 7. | G | 50. | D | 93. | |
| 8. | G# | 51. | D# | 94. | |
| 9. | A | 52. | E | 95. | |
| 10. | A# | 53. | F | 96. | |
| 11. | B | 54.. | F# | 97. | |
| 12. | C | 55. | G | 98. | 0 |
| 13. | C# | 56. | G# | 99. | |
| 14. | D | 57. | A | 100. | |
| 15. | D# | 58. | A# | 101. | |
| 16. | E | 59. | B | 102. | |
| 17. | F | 60. | C | 103. | |
| 18. | F# | 61. | C# | 104. | 0 |
| 19. | G | 62. | D | 105. | BASS THEME |
| 20. | G# | 63. | D# | 106. | BASS INTENSITY 1 |
| 21. | A | 64. | E | 107. | BASS INTENSITY 2 |
| 22. | A# | 65. | F | 108. | BASS INTENSITY 3 |
| 23. | B | 66. | F# | 109. | BASS INTENSITY 4 |
| 24. | C | 67. | G | 110. | 0 |
| 25. | C# | 68. | G# | 111. | TREBLE THEME |
| 26. | D | 69. | A | 112. | TREBLE INTENSITY 1 |
| 27. | D# | 70. | A# | 113. | TREBLE INTENSITY 2 |
| 28. | E | 71. | B | 114. | TREBLE INTENSITY 3 |
| 29. | F | 72. | C | 115. | TREBLE INTENSITY 4 |
| 30. | F# | 73. | C# | 116. | 0 |
| 31. | G | 74. | D | 117. | SUSTAIN PEDAL |
| 32. | G# | 75. | D# | 118. | SOFT PEDAL |
| 33. | A | 76. | E | 119. | |
| 34. | A# | 77. | F | 120. | |
| 35. | B | 78. | F# | 121. | 1 |
| 36. | C (MIDDLE) | 79. | G | 122. | 1 |
| 37. | C# | 80. | G# | 123. | 1 |
| 38. | D | 81. | A | 124. | 1 |
| 39. | D# | 82. | A# | 125. | 1 SYNC |
| 40. | E | 83. | B | 126. | 1 |
| 41. | F | 84. | C | 127. | 0 |
| 42. | F# | 85. | $A_{32}$ | 128. | 1 |
| 43. | G | 86. | $A\#_{32}$ | | |

(14 UNASSIGNED BITS)

FIG. 2
PRIOR ART

CIRCUIT FOR CONTROLLING THE EXPRESSION OF AN ELECTRONICALLY CONTROLLED KEYBOARD INSTRUMENT

RELATED APPLICATIONS

This application is related to the following U.S. applications as follows: U.S. Ser. Nos. 681,093, filed Apr. 28, 1976 for "Method and Apparatus for Reproducing a Musical Presentation" of Joseph Max Campbell; 681,098, filed Apr. 28, 1976 for "Demultiplex and Storage System for Time Division Multiplexed Frames of Musical Data" of William Solon Finley; and 680,996, filed Apr. 28, 1976 for "Solenoid-Hammer Control System For The Re-Creation of Expression Effects From A Recorded Musical Presentation" of Joseph Max Campbell and William Solon Finley, all incorporated herein by reference, all of which are owned by the assignee hereof.

BACKGROUND AND BRIEF DESCRIPTION OF THE INVENTION

The present invention is directed to electronic player pianos and, more particularly, to novel expression recreation systems for such instruments which are an improvement on the system for re-creating expression effects as disclosed in application Ser. No. 680,996, filed Apr. 28, 1976 for "Solenoid-Hammer Control System for the Re-Creation of Expression Effects from a Recorded Musical Presentation" of Joseph Max Campbell et al. In that application, the method of producing a variable intensity in a musical note producing implement was achieved by producing a sequence of pulses for selectively energizing the actuator for the note and then modulating the width of the pulses in the sequence according to the intensity level of the recorded digitally coded signal, whereby the average drive energy applied to the implement is proportional to the desired intensity level. In the circuit for implementing this technique, a group of binary weighted resistors were provided and the resistors were, in effect, connected in circuit with a capacitive timing system for a monostable multivibrator so that in effect, the width of pulses issuing from the monostable multivibrator corresponded to the desired intensity level of the note to be struck. The present invention is an improvement over this system in that it permits simultaneous adjustment of both the leading and trailing edges of the pulses without varying the rate of the pulses.

BRIEF DESCRIPTION OF THE DRAWINGS

FIG. 2 is a chart illustrating the bit assignment and the multiplexing thereof in a player system incorporating the invention.

DETAILED DESCRIPTION OF THE INVENTION

Figure 1:
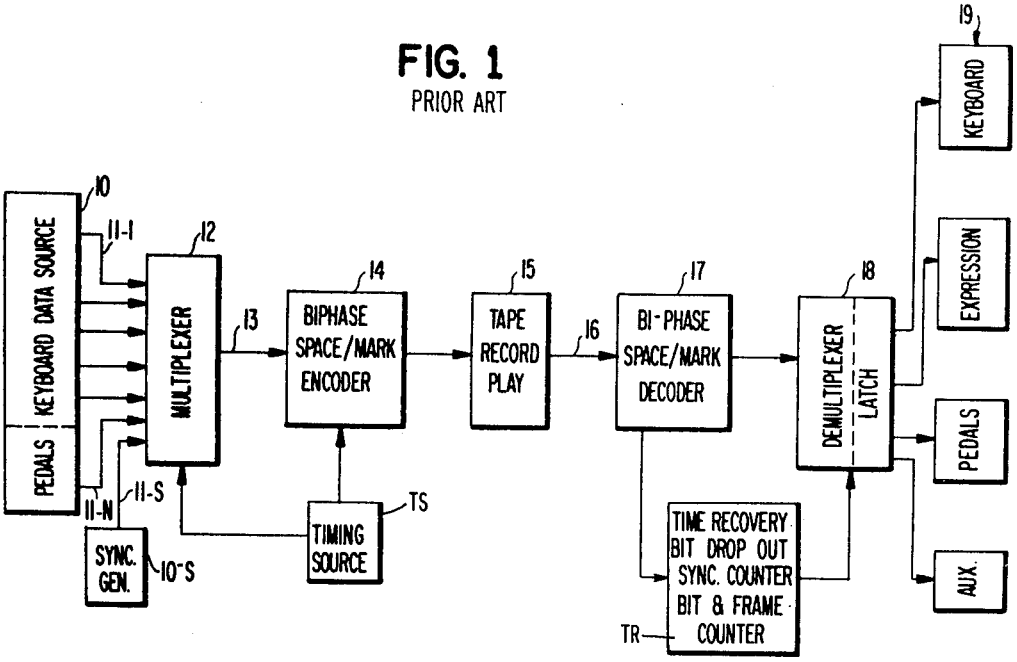
FIG. 1 PRIOR ART
FIG. 1 is a block diagram of a player piano system of the type disclosed in the aforementioned patent applications.

While the invention is concerned primarily with improvements in circuits for pulse width modulating the expression controls for bass and treble halfs of a keyboard of a keyboard-type instrument such as a piano, a brief description of the general system of the aforementioned patent application and the bass-treble expression controls of the present invention is in order. Referring now to FIG. 1, the keyboard of a piano is designated by the numeral 10 as a keyboard data source. It could be any musical keyboard instrument source such as a harpsichord, carillon, organ, piano, etc., and each output of the switch actuation is indicated by lines 11-1, 11-N with the number of such output lines corresponding to the number of key switch actuations to be sensed and recorded, as well as the sustain and soft pedals for the piano. In addition, certain auxiliary functions as are reflected in the bit assignment chart of FIG. 2 may be provided, along with a set or sequence of synchronizing bits. The multiplexer controlled by timing source TS, thus scans or looks at each individual input line in a time sequence with each recurrence of a scan cycle constituting a frame. Thus, the key switches, sustain and loud pedals, and actuations thereof along with the synchronizing data bits, along with any control data bits, are scanned one at a time and in generally sequential fashion. However, if no transpositions are contemplated, it is not necessary that they be sequentially scanned - they may be looked at or scanned in groups in any fashion or order - the only criteria being that the position of the particular switch and its scan time be maintained in the entire system.

Multiplexer 12 thereby translates the parallel data of the key switch actuations to serial data stream along its output line 13. This data is then encoded, in the preferred embodiment, to a bi-phase space or mark signal in a bi-phase space/mark encoder 14, also controlled by timer TS, and then recorded on magnetic tape in recorder 15. There is a slight difference in the time when the key of a piano, for example, is struck and when the note reaches the maximum sound intensity, so that if microphone type intensity detectors are utilized, a delay may be introduced into the encoding of the keyboard binary bits at positions 1–88 of the bit assignment chart of FIG. 2. On the other hand, acceleration sensing devices or other forms of transducers may be used to measure the acceleration or force with which the key is struck by the artist and this data converted to binary form as the expression data for recording on tape without such delay and in bit positions 105–109 for the bass intensity levels and 111–115 for the treble intensity levels. (See the bit assignment chart shown in FIG. 2). The tapes may be recorded beforehand by known or accomplished artists in home recordings, or as rerecordings of punched paper rolls, etc. which have expression signal information therein so that one need not equip a piano for the record function. Thus, the particular manner by which the expression data is detected and recorded forms no part of the present invention. On playback by the tape play unit 15, the bi-phase space or mark data appears at the output of a read head (not shown), fed through correcting networks and amplifiers to recover the digital signal which has included therein clock data which is recovered in "TIME RECOVERY, BIT DROPOUT, SYNC COUNTER, BIT & FRAME COUNTER" TR and used in the demultiplexing operation. The bi-phase space/mark decoder circuit 17 decodes the incoming data on line 16, applies same to demultiplexer 18 which distributes the data to the appropriate control channels and the latch storage circuits for solenoid actuator circuits 19. Instead of solenoid actuators, of course, other forms of electromagnetically controlled acutators may be used such as electromagnetic clutches and the like.

PRIOR ART ARRANGEMENTS

Figure 3:
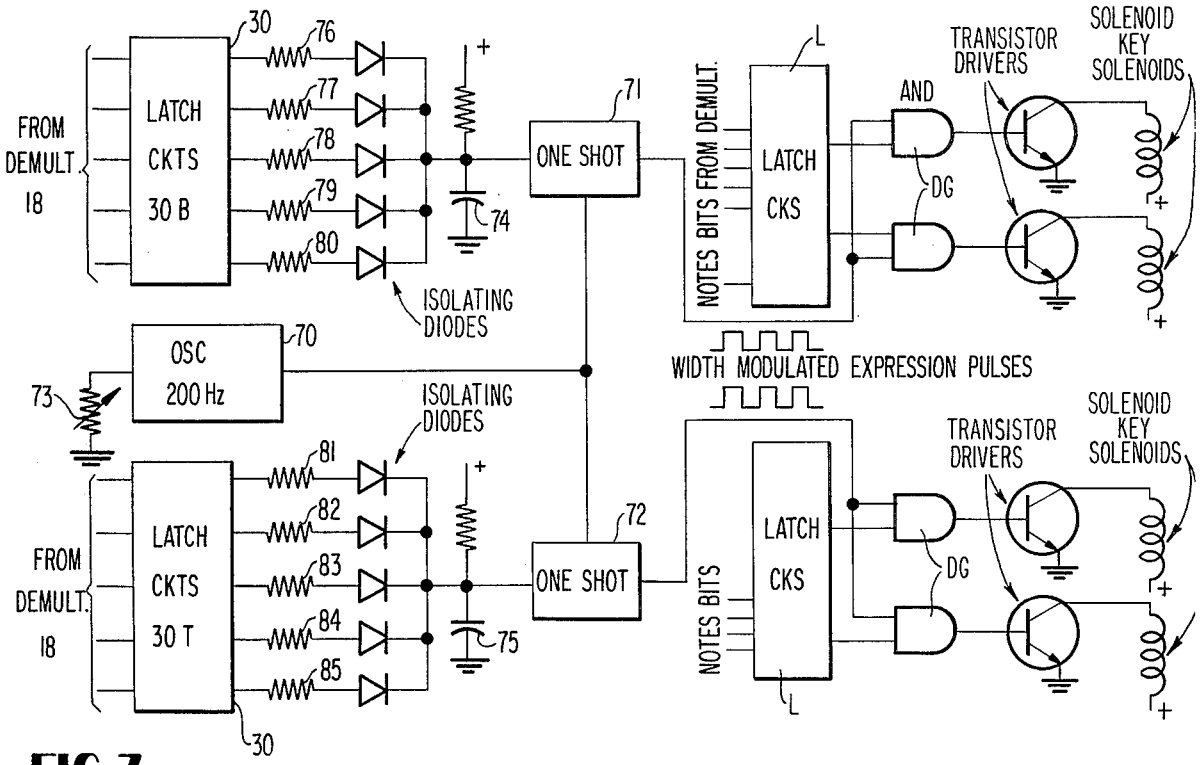
FIG 3 PRIOR ART
FIG. 3 is a schematic circuit diagram illustrating the expression circuit system of the aforementioned patent application Ser. No. 680,996, filed Apr. 28, 1976.

The earlier arrangement shown in FIG. 3 of which the present circuit is an improvement, comprises expression control latch circuits 30 which receive and decode a signal which constitutes the information corresponding to the detected intensity level or the recorded intensity level for the bass and treble halves of the keyboard and these are assigned different data bit positions in the frames of recorded data bits of the time division multiplex record system as shown in FIG. 2. The binary bits are weighted and used to modulate the width of pulses supplied to selected solenoids which actuate the striker hammer members of the instrument, so that the average drive energy supplied to a solenoid is proportional to the desired intensity to thereby reproduce the manual action of the original performance and secure a better musical quality in the playback. Bit counter outputs from the demultiplexing operation are transferred to latch circuits, there being a group of note latch circuits L for each note to be struck. There is a group of expression latch circuits 30 for storing the expression and pedal information contained in the frame of data at bit positions 105–109, 111–115 and 117–118. In addition, each of the latch circuits L as described above, stores the musical information contained in a data cell of the 128 bit time frame (see FIG. 2), and the driver transistor AND gates DG, one for each key on the keyboard, receives as one input a signal from the latch or storage circuits L. The second input to the driver transistor AND gate DG is a sequence of pulses which are width modulated according to the information stored in expression and pedal latch control circuits 30B and 30T.

The low frequency oscillator 70 supplies pulses to a pair of pulse width modulatable one shot multivibrators 71 and 72 for the bass and treble key, respectively, with the pulses from the oscillator having their minimum widths set by variable resistors resistor 73 to thereby set the minimum width of the pulses from multivibrator 71 and 72. Each of the multivibrators 71 and 72 has its timing set by capacitors 74 and 75, respectively, in conjunction with resistors 76–80 for the bass volume and the resistors 81–85 for the treble volume. Combinations of resistors 76–80 and combinations of resistors 81–85 by the information from demultiplexer 18 which have been stored in expression and pedal latch control circuits 30. This stores the treble and bass expression bits in the latch circuits 30 (30B and 30T) along with the soft and sustain pedal controls (the control provided by these signals is not relevant to the present invention and is not discussed in detail herein). The stored bits are used to vary the number of resistors 76–80 and 81–85 (which are essentially binary weighted) in circuit with the timing capacitors 74 and 75 to thereby vary the charging rate of the capacitors according to the combination of resistors which have been, in effect, connected in circuit with capacitors 74, 75, respectively, to thereby vary the width of the pulses for the base and treble effects.

THE PRESENT INVENTION

Figure 4:
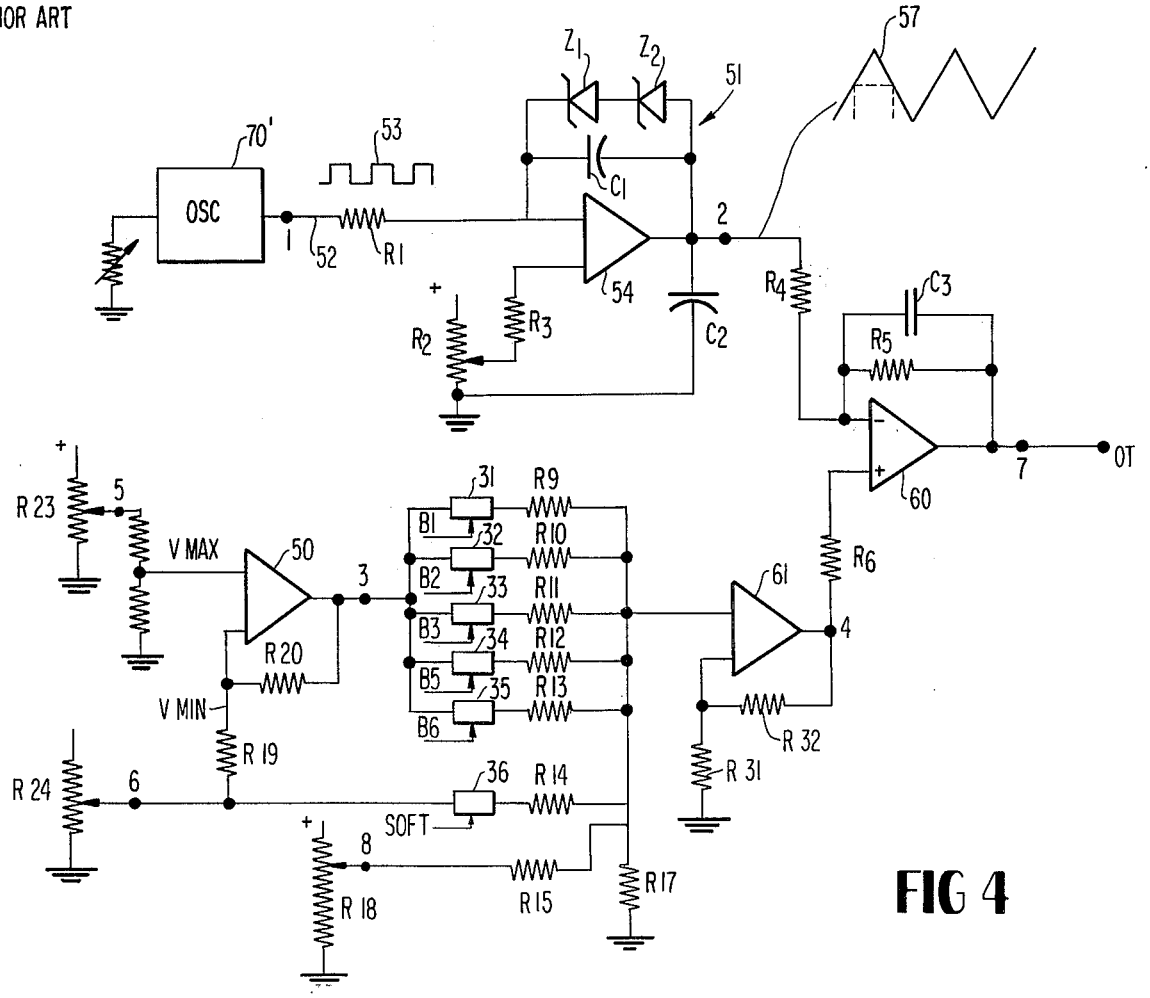
FIG. 4 is a schematic diagram of the improved expression control system incorporating the invention.

The present invention is an improvement over this circuit and provides more accurate control. Referring now to FIG. 4, the circuit incorporates the basic principle of the aforesaid application Serial No. 680,996 in that a solenoid is switched on and off at a rapid rate and then varying the time on versus the time off to thereby vary the energy supplied to the solenoid and hence the force striking the piano is changed.

The expression for the electronic player piano key shown in FIG. 4 is one half of the expression control input, which may be either the treble or bass halves but both are their duplicates of one another, so only one will be described. These are controlled by the digital inputs B1, B2, B3, B4, and B5, and the soft input, corresponding to the bass theme, bass intensity 1, bass intensity 2, bass intensity 3, bass intensity 4, which are the bits of data stored at bit positions 105, 106, 107, 108, and 109, respectively, of the bit assignment chart of FIG. 2 and the electronic switches 31–36 controlled thereby simply connect the resistors R9, R10, R11, R12, R13, and R14, respectively, in the circuit. The wiper of potentiometer R23 (circuit point 5) selects a voltage level Vmax which is applied to the comparator 50 and the wiper of potentiometer 24 (circuit point 6) selects a voltage level Vmin applied to comparator 50 to thereby establish the minimum or low level for the intensity. The digital inputs B1, B2, B3, B4, and B5 are weighted binary and cause the piano to play at intensity levels between the minimum level setting of R24 and a maximum level setting of R23. This provides a much more flexible control over the different levels of intensity or expression for the piano and provides a wide range of variations in the playback, not hitherto available. The output pulse train at output terminal OT (circuit point 7) is determined by comparator 60, which is an integrated circuit comparator amplifier. Comparator 60 has an output which is high as long as the plus input is greater than the minus input. The minus input of the comparator is provided by a conventional triangular waveform generator 51. The pulse train input on line 52 (circuit point 1) comes from any convenient source such as an oscillator 70' which operates at about a 200 Hz rate and provides a sequence of square wave pulses 53 via resistor R1 to the input terminal of intergrating amplifier 54 in the triangular waveform generator 51. The capacitor C1 and the back-to-back zener diodes Z1, Z2 provide the ascending and descending ramp portions of the output waveform 57. Capacitor C2 and resistors R2, R3 set the slope.

The triangular waveform 57 (at circuit point 2) is coupled through coupling resistor R4 to the minus input of differential amplifier 60. Hence, the sum voltage appearing on the output of adding or summing amplifier 61 (provided with conventional feedback resistors $R_{31}$ and $R_{32}$) applied to the positive input of differential amplifier 60. Thus, the width of the pulses and the pulse appearing at the output terminal OT (circuit point 7) are width modulated at both the leading and trailing edges thereof and in amounts as determined by the respective slopes of the rising and falling ramp voltages constituting the triangular waveform voltage 57. Thus, the greater or larger the voltage at the output of summing amplifier 61, the greater voltage is applied at the positive terminal of difference amplifier 60, thereby rising higher on the rising and falling ramps of the waveform 57, thereby producing a greater pulse width at the output terminal OT (circuit point 7) and so that more energy is delivered to the key and the piano is played louder. The voltage at the output of summing amplifier 61 is the sum of the voltage on the wiper (circuit point 8) of potentiometer R18, and coupled through resistor R15, is just enough bias voltage to give a minimum pulse output. The voltage at the wiper of potentiometer R24 is weighted by the "soft" input and the voltage at the output of amplifier 50 is binarily weighted by the digital inputs B1, B2, B3, B4, and B5. The voltage at the output of amplifier 50 is the difference of the voltage supplied on the wiper of the potentiometer R23 and the minimum level voltage on the wiper of the potentiometer for resistor R24. By adjusting resistors R23 and R24, the expression of the piano can be varied from a minimum level to a maximum intensity level and individually at each extreme. Resistors R9 through R13 are binarily weighted resistors such that R13 = 2 R12 = 4 R11 = 8 R10 = 16 R9. The B1 through B5 bits can be controlled to give 32 levels between the maximum and minumum. Finally, switches 31–35 are complementary MOS solid state switches that are on with the digital high and off with the digital low.

While the invention has particular utility with respect to player pianos, other musical instruments may be operated in accordance with the principles hereof. Moreover, the circuit for pulse width modulating rectangular pulses to vary the energy content thereof may be used in other environments. While the invention has been described and illustrated herein by reference to a preferred embodiment, it is to be understood that various changes and modifications may be made in the invention by those skilled in the art without departing from the spirit and scope thereof as determined by the appended claims.

What is claimed is:

1. In an electronically controlled player piano system having a piano keyboard wherein the keys thereof are solenoid operated, and provided with transistor switch means controlling the operating current to the solenoids, a source of signals for controlling the operation of the solenoids for causing the keys to be struck and produce the notes of a musical presentation as recorded on a record medium, said record medium also having recorded thereon expression information collated with the musical presentation, said expression information being recorded in the form of binary coded expression information bits on said record medium, the improvement in re-creating the expression effects comprising:

means to generate a triangular waveform voltage, means adapted to receive said binary coded expression information bits and generate one of a plurality of discrete voltage levels, each discrete voltage level corresponding to an expression level defined by said binary coded expression bits, difference amplifier means having a pair of input terminals and an output terminal, means to apply said triangular waveform voltage to one of said input terminals, means to apply one of said discrete voltage levels as produced by said means to generate a plurality of discrete voltage levels to the other of said input terminals of said difference amplifier means to produce a sequence of pulse width modulated pulses having a rate corresponding to the rate of said triangular waveform voltage and width corresponding to the coincident level of said one discrete voltage level with respect to said triangular waveform voltage and the projection of the points of coincidence on the time axis thereof being the width of said pulses, gate circuit means receiving as inputs the signals from said difference amplifier and said signals for controlling the operation of said solenoids, and means connecting said gate circuit means to the said transistor switch means for controlling said solenoids and thereby re-create the expression effects for said musical presentation.

2. In an apparatus for the re-creation of a recorded musical presentation on a key operated musical instrument wherein the keys of said instrument are operated by electrical solenoids, said apparatus having transistor switch means for energizing said solenoids from a source of electrical energy, a record medium carrying said recorded musical presentation and expression effects therefor as digital signals for operating said transistor switch means, and means for re-creating said expression effects including means to vary the width of signal pulses controlling said transistor switch means, the improvements in said means to vary the width of signal pulses controlling said transistor switch means comprising:

first, second and third voltage level generating means, means for combining said first and said second voltage levels to produce a fourth voltage level intermediate said first and said second voltage levels, means for dividing the fourth voltage level into selected binary weighted discrete levels, means controlled by said expression effects signal for selecting different ones of said binary weighted discrete levels according to the intensity of the signal to be played and combining same with said third voltage level constituting a plurality of fifth voltage levels which are each a discrete level according to a selected intensity level of music to be played, means for generating a triangular waveform voltage, difference amplifier means, means for applying one of said fifth voltage levels to one input of said difference amplifier means, and means for applying said triangular waveform voltage to the other input of said amplifier to thereby produce a sequence of pulse width modulated pulses having a rate corresponding to the rate of said triangular waveforms and an amplitude and width corresponding to the coincident level of said fifth voltage level with respect to said triangular waveform voltage and the projection of the points of coincidence on the time axis being the width of said pulses.

3. The invention defined in claim 2 including means for varying the slope of said triangular waveform.

4. The invention defined in claim 2 wherein said instrument has means providing soft and sustain pedal control signals, the improvement comprising said means controlling said third voltage level generating means by said soft and sustain pedal control signals, respectively.

* * * * *